United States Patent [19]

Kerstetter

[11] 4,150,318

[45] Apr. 17, 1979

[54] LOW MASS, INDIRECTLY HEATED, FAST WARM-UP HEATER-CATHODE ASSEMBLY

[75] Inventor: Donald R. Kerstetter, Emporium, Pa.

[73] Assignee: GTE Sylvania Incorporated, Stamford, Conn.

[21] Appl. No.: 896,641

[22] Filed: Apr. 17, 1978

[51] Int. Cl.[2] ..... H01J 1/24

[52] U.S. Cl. ..... 313/340; 313/346 R

[58] Field of Search ..... 313/340, 337, 346 R

[56] References Cited

U.S. PATENT DOCUMENTS

| | | | |
|---|---|---|---|
| 3,881,124 | 4/1975 | Buescher et al. | 313/37 |
| 3,947,715 | 3/1976 | Puhak | 313/337 X |
| 3,958,146 | 5/1976 | Buescher et al. | 313/337 X |
| 4,009,409 | 2/1977 | Buescher et al. | 313/337 |

*Primary Examiner*—Alfred E. Smith
*Assistant Examiner*—Charles F. Roberts
*Attorney, Agent, or Firm*—William H. McNeill

[57] ABSTRACT

A substrate of substantially pure, hexagonal crystal, $\alpha$ alumina (sapphire) has a central hub and three radiating spokes. One surface of the substrate has a metallized cathode base thereon and the opposite surface is provided with a metallized heater. Electrical connection to the cathode base and heater are provided via the spokes, which are also appropriately metallized. A suitable electron emissive material is applied to the cathode base.

5 Claims, 5 Drawing Figures

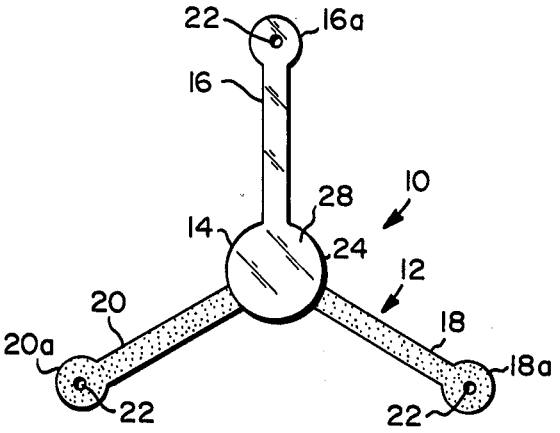
FIG. 1
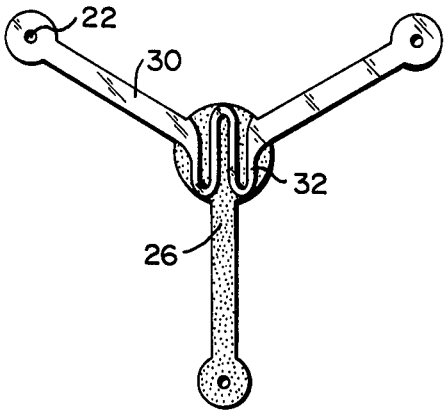
FIG. 2
FIG. 3
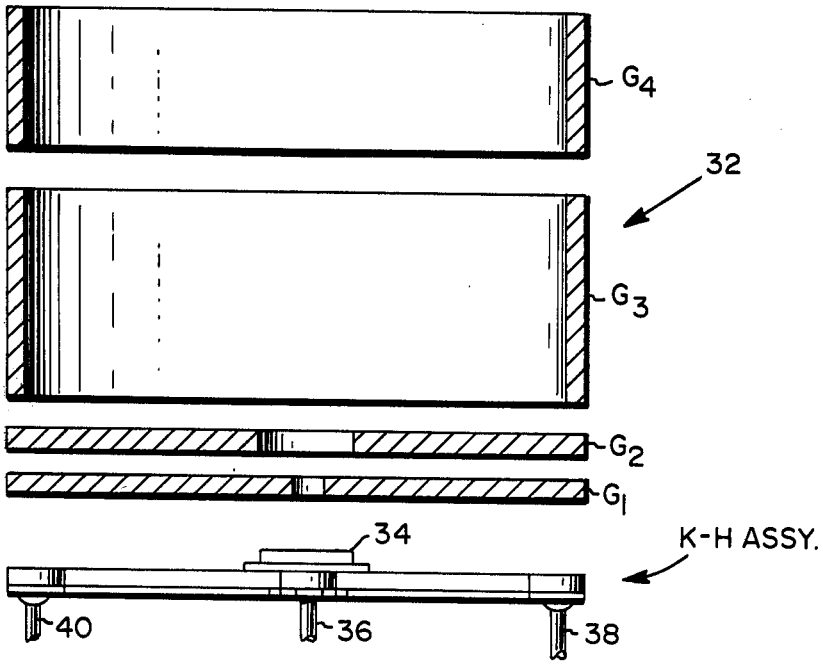
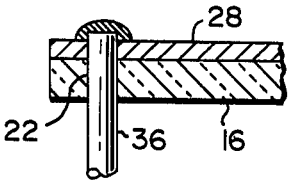
FIG. 4
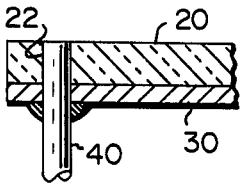
FIG. 5

LOW MASS, INDIRECTLY HEATED, FAST WARM-UP HEATER-CATHODE ASSEMBLY

BACKGROUND OF THE INVENTION

This invention relates to heater-cathode assemblies and more particularly to such assemblies which have fast warm-up characteristics and are suitable for use in cathode ray tubes of the type employed in television receivers.

The cathodes conventionally used in such tubes have a warm-up time of 12 to 15 seconds; that is, it requires that long a time for sufficient electrons to be present from the cathode to be drawn to the anode and establish a viewable raster on the screen of the tube.

Previously used fast warm-up cathodes (with warm-up time from 3.5 to six seconds) have employed various modifications of conventional cathodes such as are shown in U.S. Pat. Nos. 3,881,124; 3,947,715; 3,958,146 and 4,009,409 or they have employed complicated and expensive structures.

However, it is believed it would be an advance in the art to provide a simple and economical cathode with warm-up times faster than those heretofore achieved.

OBJECTS AND SUMMARY OF THE INVENTION

It is, therefore, an object of the invention to obviate the disadvantages of the prior art.

It is another object of the invention to enhance fast warm-up cathodes.

Yet another object of the invention is the provision of a fast warm-up cathode-heater assembly that is simple and economical to build.

These objects are accomplished in one aspect of the invention by the provision of a cathode-heater assembly which comprises a ceramic substrate having opposed surfaces. The surfaces are metallized in discrete patterns to provide a cathode base on one surface and a heater on the opposite surface. The substrate has a central core with three radially extending spokes which are also metallized and serve as portions of the appropriate electrical leads. In the complete structure, the cathode base is provided with an electron emissive material thereon. This assembly is simple and economical to fabricate and will provide a warm-up time of less than 2.5 seconds.

BRIEF DESCRIPTION OF THE DRAWINGS

FIG. 1 is a plan view of the cathode surface of the assembly;

FIG. 2 is a plan view of the heater surface of the assembly;

FIG. 3 is a diagrammatic, partially sectioned view of an electron gun employing the invention; and FIGS. 4 and 5 are partial sectional views illustrating a manner of making electrical connections to the heater and cathode surfaces of the invention.

DESCRIPTION OF THE PREFERRED EMBODIMENTS

For a better understanding of the present invention, together with other and further objects, advantages and capabilities thereof, reference is made to the following disclosure and appended claims taken in conjunction with the above-described drawings.

Referring now to the invention with greater particularity there is shown in FIG. 1 a heater-cathode assembly 10 comprising a ceramic substrate 12, which is preferably substantially pure hexagonal crystalαalumina (sapphire). Substrate 12 has a central hub 14 with three radially extending spokes 16, 18, 20 whose free ends 16*a*, 18*a*, 20*a*, terminate at the apices of an equilateral triangle. Further, the free ends 16*a*, 18*a*, 20*a* are wider than the remainder of the spokes and are provided with apertures 22.

Since substrate 12 is planar it has opposed surfaces 24 and 26. Surface 24 is provided with a metallized layer 28 which substantially covers hub 14 and one spoke, in this instance spoke 16. Layer 28 provides the cathode base. Opposed surface 26 (FIG. 2) is provided with a metallized layer 30 which provides a heater 32 which may have a serpentine configuration on hub 14 and which extends along the two remaining spokes, 18 and 20 and forms the heater portion of the assembly 10. A thinner layer of conductive material or a layer of material with a high electrical resistance can also be employed to the same purpose. Numerous techniques are available for depositing the metallized layers 28 and 30. A preferred method is to vapor deposit a suitable material such as molybdenum, nickel, cobalt or tungsten on substrate 12 and then, using conventional photo-resist techniques, etching out the desired pattern.

As noted above, substrate 12 is a preferably synthetic sapphire; however, other aluminas of at least 97% purity may be employed. The material should be as thin as possible to still maintain the necessary mechanical strength, and ranges of between 0.006″ to 0.007″ are preferred.

Referring now to FIG. 3, cathode-heater assembly 10 is shown as part of an electron gun 32 comprised of $G_1$, $G_2$, $G_3$, and $G_4$ electrodes for providing focussing and accelleration of an electron beam. The cathode base, of course, is provided with a suitable layer of an electron emissive material 34.

Power to the cathode and heater is provided by connectors 36, for the cathode, and 38, 40 for the heater. These connectors are fitted within apertures 22 and brazed or welded to the appropriate layers, as is shown in FIGS. 4 and 5.

In the embodiment shown, and with a layer of emissive material 34 on hub 14 approximately 0.060″ in diameter, the cathode area can be brought to raster temperature (450° C.) within 2.5 seconds. To achieve this condition power is applied to achieve a terminal temperature of 800° C. The power input for achieving the 800° C. is below 1/2 watt with heater power being 250 ma at approximately 2 volts.

This low mass, indirectly heated cathode-heater assembly thus is seen to provide exceptional results. It is simple and economical to construct and advances the art.

While there has been shown what is at present considered to be the preferred embodiment of the invention, it will be apparent to those skilled in the art that various changes and modifications can be made herein without departing from the scope of the invention as defined by the appended claims.

What is claimed is:

1. A low mass, indirectly heated, fast warm-up cathode-heater assembly for an electron discharge device comprising: a substrate of substantially pure, hexagonal crystalαalumina, said substrate having a central hub having three radially extending spokes whose ends terminate at the apices of an equilateral triangle and opposed surfaces; a first metallized layer on one of said surfaces covering a substantial part of said hub and one of said spokes; and a second metallized layer on an opposite surface and including the other two spokes and a heater section on said hub.

2. The assembly of claim 1 wherein said spoke termini are substantially circular.

3. The assembly of claim 2 wherein said termini are apertured.

4. The assembly of claim 1 wherein said first metallized layer on said hub has thereon an electron emissive material.

5. The assembly of claim 3 wherein said apertures contain electrical leads connected to said layers to supply appropriate voltages to said layers.

* * * * *